US007992982B2

(12) United States Patent
Scharf

(10) Patent No.: US 7,992,982 B2
(45) Date of Patent: Aug. 9, 2011

(54) PRINTHEAD CARRIER WITH LATCHING DEVICES

(75) Inventor: Bryan Christopher Scharf, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 1168 days.

(21) Appl. No.: 11/692,518

(22) Filed: Mar. 28, 2007

(65) Prior Publication Data

US 2008/0239026 A1 Oct. 2, 2008

(51) Int. Cl.
*B41J 2/175* (2006.01)
*B41J 23/00* (2006.01)

(52) U.S. Cl. ..... 347/86; 347/37

(58) Field of Classification Search ..... 347/37, 347/85–87

See application file for complete search history.

(56) References Cited

U.S. PATENT DOCUMENTS 6,102,533 A * 8/2000 Nozawa et al. ..... 347/86
6,481,829 B1 * 11/2002 Bailey et al. ..... 347/49
2005/0275700 A1 * 12/2005 Buchanan et al. ..... 347/86

* cited by examiner

*Primary Examiner* — Geoffrey Mruk

(57) ABSTRACT

An imaging apparatus configured for mounting an ink supply cartridge includes a guide frame defining a main scan direction. A printhead carrier for mounting the ink supply cartridge is coupled to the guide frame. The printhead carrier includes a housing cradle. A first latch device is pivotably coupled at a first axis to a front portion of the housing cradle, the first latch device being rotatable between a first latched position and a first unlatched position. A second latch device is pivotably coupled at a second axis to a rear portion of the housing cradle, the second latch device being rotatable between a second latched position and a second unlatched position. The first latch device and the second latch device are configured to define a top opening for vertically receiving the ink supply cartridge between the first latch device and the second latch device.

18 Claims, 4 Drawing Sheets

PRINTHEAD CARRIER WITH LATCHING DEVICES

BACKGROUND OF THE INVENTION

1. Field of the Invention

The present invention relates to an imaging apparatus, and, ore particularly, to a printhead carrier with latching devices.

2. Description of the Related Art

An imaging apparatus, such as an ink jet printer, forms an image on a print medium, such as paper, by applying ink to the print medium. Such an ink jet printer includes a reciprocating printhead carrier that transports one or more ink jet printhead cartridges across the print medium along a bi-directional scanning path defining a print zone of the printer. An ink jet printhead cartridge, for example, includes both an ink tank containing ink and an ink jet micro-fluid ejection device, i.e., ink jet printhead, for selectively ejecting the ink. Each ink jet printhead cartridge is mounted to the printhead carrier.

There is an increasing desire to reduce the size of printers. It is typical for printers to have carrier latches that hold their respective printhead cartridges in place on the printhead carrier. In one such carrier latch design, the latches are located at the rear of the printhead carrier, and extend above the ink tank by about 10 to 15 millimeters.

SUMMARY OF THE INVENTION

The present invention provides a low-profile top load printhead carrier.

The terms "first" and "second" preceding an element name, e.g., first latch device, second latch device, etc., are used for identification purposes to distinguish between similar elements, and are not intended to necessarily imply order, nor are the terms "first" and "second" intended to preclude the inclusion of additional similar elements.

The invention, in one form thereof, is directed to an imaging apparatus configured for mounting an ink supply cartridge. The imaging apparatus includes a guide frame defining a main scan direction. A printhead carrier for mounting the ink supply cartridge is coupled to the guide frame for reciprocating movement along the main scan direction. The printhead carrier includes a housing cradle having a front portion and a rear portion. A first latch device is pivotably coupled at a first axis to the front portion of the housing cradle, the first latch device being rotatable between a first latched position and a first unlatched position. A second latch device is pivotably coupled at a second axis to the rear portion of the housing cradle, the second latch device being rotatable between a second latched position and a second unlatched position. The first latch device and the second latch device are configured to define a top opening for vertically receiving the ink supply cartridge between the first latch device and the second latch device.

The invention, in another form thereof, is directed to a printhead carrier for mounting and latching an ink supply cartridge. The printhead carrier includes a housing cradle having a front portion and a rear portion. A first latch device is pivotably coupled at a first axis to the front portion of the housing cradle, the first latch device being rotatable between a first latched position and a first unlatched position. A second latch device is pivotably coupled at a second axis to the rear portion of the housing cradle, the second latch device being rotatable between a second latched position and a second unlatched position. The first latch device and the second latch device are configured to define a top opening for vertically receiving the ink supply cartridge between the first latch device and the second latch device.

The invention, in another form thereof, is directed to a printhead carrier for mounting and latching an ink supply cartridge. The printhead carrier includes a housing cradle having a front portion and a rear portion. A first latch device is pivotably coupled at a first axis to the front portion of the housing cradle. The first latch device is rotatable between a first latched position and a first unlatched position. The first latch device has a first sidewall having a first interconnecting feature. A second latch device is pivotably coupled at a second axis to the rear portion of the housing cradle. The second latch device is rotatable between a second latched position and a second unlatched position. The second latch device has a second sidewall having a second interconnecting feature positioned to engage the first interconnecting feature of the first sidewall in a central region between the first axis and the second axis. By virtue of the engagement of the first interconnecting feature with the second interconnecting feature, a rotation of the first latch device in a first rotational direction results in a corresponding rotation of the second latch device in a second rotational direction opposite to the first rotational direction.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, in one form, and such exemplifications are not to be construed as limiting the scope of the invention in any manner.

DETAILED DESCRIPTION OF THE INVENTION

Figure 1:
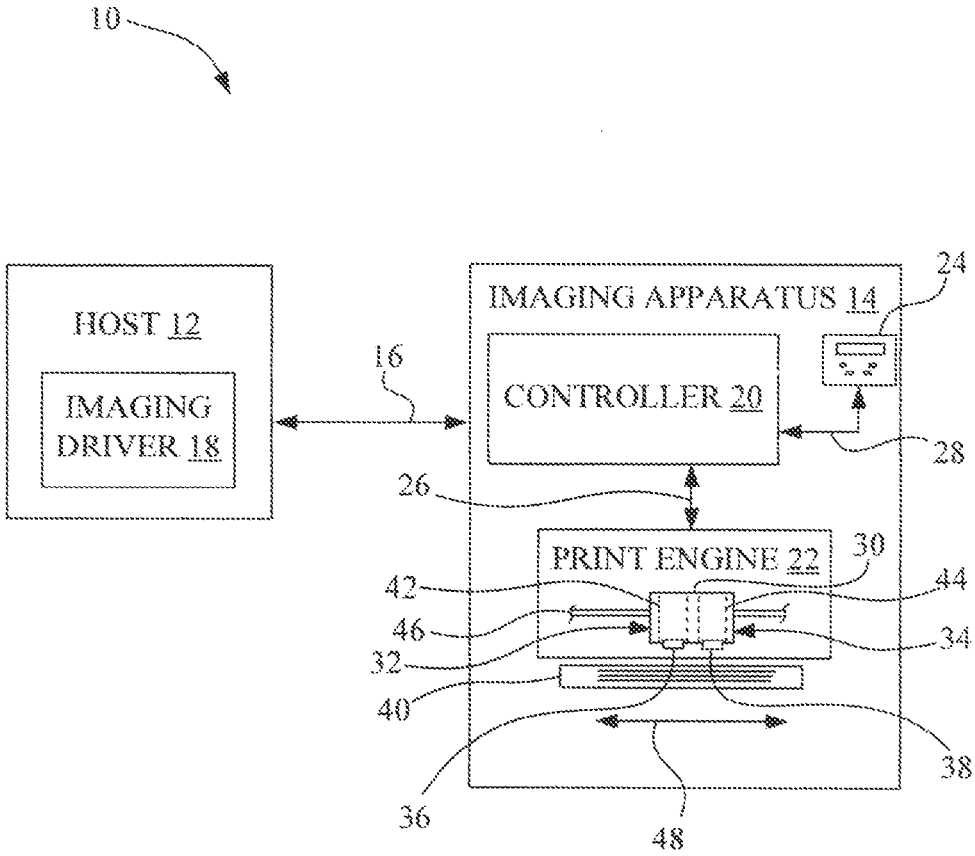
FIG. 1 is a diagrammatic depiction of an imaging system having an imaging apparatus configured in accordance with an embodiment of the present invention.

Referring now to the drawings, and particularly to FIG. 1, there is shown a diagrammatic depiction of an imaging system 10 embodying the present invention. Imaging system 10 includes a host 12 and an imaging apparatus 14. Imaging apparatus 14 communicates with host 12 via a communications link 16.

As used herein, the term "communications link" generally refers to structure that facilitates electronic communication between two components, and may operate using wired or wireless technology. Accordingly, communications link 16 may be, for example, an electrical wired connection (e.g., universal serial bus (USB)), a wireless connection (e.g., Bluetooth, IEEE 802.11, etc.), and may be a network connection, such as for example, an Ethernet local area network (LAN).

Host 12 may be, for example, a personal computer, that includes a processor, input/output (I/O) interfaces, memory and at least one mass data storage device, such as a hard drive, a CD-ROM and/or a DVD unit. During operation, host 12 includes in its memory a software program including program instructions that function as an imaging driver 18, e.g., printer driver software, for imaging apparatus 14. Imaging driver 18 facilitates communication between imaging apparatus 14 and host 12, and may provide formatted print data to imaging apparatus 14. Although imaging driver 18 is located as residing in host 12, it is contemplated that, alternatively, all or a portion of imaging driver 18 may be located in imaging apparatus 14.

Imaging apparatus 14 may be, for example, an ink jet printer and/or copier, or an all-in-one (AIO) unit that includes an ink jet printer, a scanner, and possibly a fax unit. In the present embodiment, imaging apparatus 14 may include, for example, a controller 20, a print engine 22, and a user interface 24.

Controller 20 includes a processor unit and associated memory, and may be formed as one or more Application Specific Integrated Circuits (ASIC). Controller 20 is communicatively coupled to print engine 22 via a communications link 26, and to user interface 24 via a communications link 28. Controller 20 serves to process print data and to operate print engine 22 to perform printing.

Print engine 22 may include a reciprocating printhead carrier 30 that is configured to mount and carry, for example, one or more of a first e.g., color, ink supply cartridge 32 and a second, e.g., monochrome (e.g., black), ink supply cartridge 34. Associated with color ink supply cartridge 32 is a printhead 36 having an array of ink jet nozzles for ejecting ink, and associated with monochrome ink supply cartridge 34 is a printhead 38 having an array of ink jet nozzles for ejecting ink. Print engine 22 operates printheads 36, 38 to eject ink droplets onto a print medium 40, such as paper, in order to reproduce text or images, etc.

Color ink supply cartridge 32 includes an ink tank 42, which in one embodiment may be formed integral with printhead 36 to form a color printhead cartridge. In this case, the entire printhead cartridge is mounted as a unit to the printhead carrier, and is replaced as a unit when the associated ink supply is depleted. Alternatively, color ink supply cartridge 32 may only include ink tank 42, with printhead 36 being semi-permanently mounted to the printhead carrier 30, and with ink tank 42 being uncoupled from printhead 36 and replaced when the associated ink supply is depleted.

Likewise, monochrome ink supply cartridge 34 includes an ink tank 44, which may be formed integral with printhead 38 to form a monochrome printhead cartridge. In this case, the entire printhead cartridge is mounted as a unit to the printhead carrier, and is replaced as a unit when the associated ink supply is depleted. Alternatively, monochrome ink supply cartridge 34 may only include ink tank 44, with printhead 38 being semi-permanently mounted to the printhead carrier 30, and with ink tank 44 being uncoupled from printhead 38 and placed when the associated ink supply is depleted.

Color ink supply cartridge 32 may include various colors of ink, such as for example, cyan (C), magenta (M), and yellow (Y) inks. In some embodiments, monochrome ink supply cartridge 34 may be replaced with a photo ink supply cartridge to facilitate six color printing. For example, a photo ink supply cartridge typically includes diluted inks of certain colors, such as diluted cyan (c), and diluted magenta (m) inks, whereas color ink supply cartridge 32 may include only saturated inks. The term, "saturated" refers to the fact that the inks are full-strength such as the inks used by conventional CMYK ink jet printers, and are not, for example, diluted inks. The inks may be, for example, one or both of pigment-based inks and dye-based inks.

Print engine 22 may include, for example, a guide frame 46 to which printhead carrier 30 is slidably coupled to facilitate reciprocating motion. Guide frame 46 defines a bi-directional main scan direction 48. During a printing operation, guide frame 46 guides printhead carrier 30 back and forth along bi-directional main scan direction 48, and in turn printhead carrier 30 transports ink supply cartridges 32, 34 and the associated printheads 36, 38 in a reciprocating manner over an image surface of print medium 40.

Figure 2:
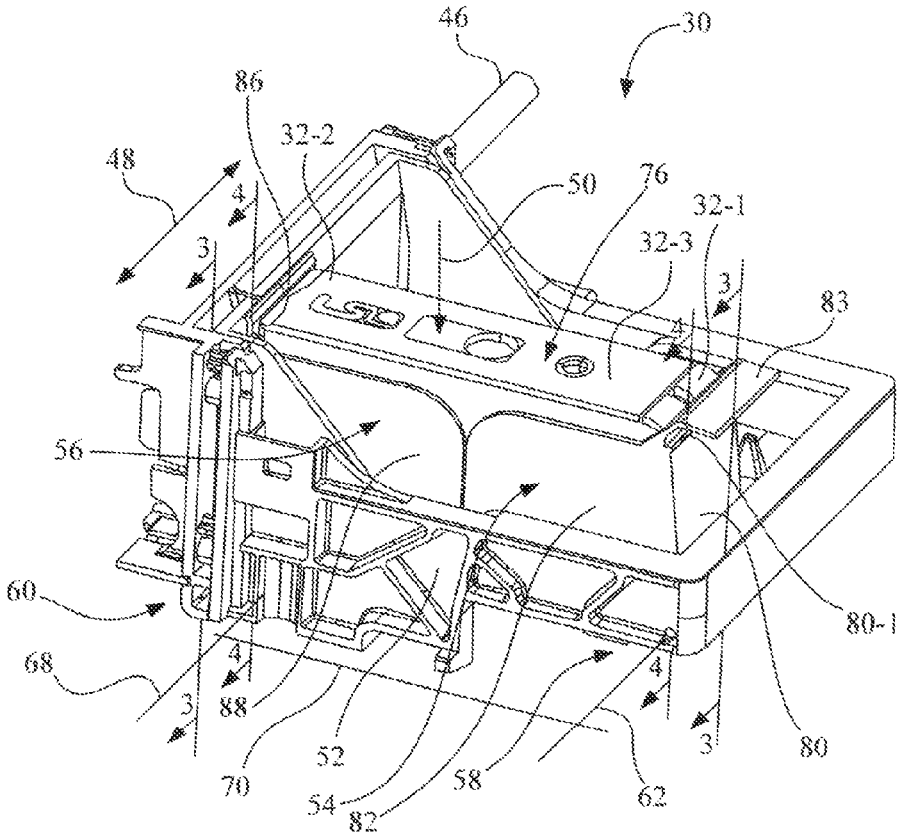
FIG. 2 is a perspective view of the printhead carrier of the imaging apparatus of FIG. 1, in accordance with an embodiment of the present invention.

In the exemplary embodiment of FIG. 2, printhead carrier 30 is sized to facilitate top entry loading of two ink supply cartridges 32, 34 in vertical direction 50, from top to bottom. For simplicity and ease of discussion, only the configuration that accommodates ink supply cartridge 32 is shown and will be described below. However, those skilled in the art will recognize that the carrier configuration used to accommodate ink supply cartridge 32 in accordance with the present invention may be used to accommodate each of addition ink supply cartridges, e.g., ink supply cartridge 34, separately or in unison with ink supply cartridge 32. Those skilled in the art will recognize that the principles of the present invention, as described below, may be applied to printhead carriers that accommodate any number of printhead cartridges.

Printhead carrier 30 includes a housing cradle 52, a first latch device 54, and a second latch device 56. Housing cradle 52 has a front portion 58 and a rear portion 60.

Referring also to FIGS. 3-6, first latch device 54 is pivotably coupled at a first axis 62 to front portion 58 of housing cradle 52. The pivotable coupling may be accomplished, for example, via a hinge arrangement (e.g., shaft/bushing arrangement, or a pin/hole arrangement) as is known in the art. First latch device 54 is rotatable between a first latched position 64 (see, e.g., FIG. 4) and a first unlatched position 66 (see, e.g., FIG. 5).

Second latch device 56 is pivotably coupled at a second axis 68 to rear portion 60 of housing cradle 52. The pivotable coupling may be accomplished, for example, via a hinge arrangement (e.g., a pin and hole) as is known in the art. First axis 62 and second axis 68 are located on a substantially horizontal plane 70. Second latch device 56 is rotatable between a second latched position 72 (see, e.g., FIG. 4) and a second unlatched position 74 (see, e.g., FIG. 5).

First latch device 54 and second latch device 56 teeter/actuate in opposite directions around respective axes 62, 68, which permits ink supply cartridge 32, or multiple ink supply cartridges, to be latched or unlatched.

First latch device 54 and second latch device 56 are configured and arranged to define a top opening 76 for vertically receiving (in vertical direction 50) ink supply cartridge 32 between first latch device 54 and second latch device 56.

First latch device 54 includes a front latch member 80 and a first sidewall 82. In some embodiments, first sidewall 82 may be accompanied by an opposing sidewall 82-1 (see, e.g., FIG. 5) that is spaced apart from first sidewall 82 in a direction parallel to bi-directional main scan direction 48. Front latch member 80 extends upwardly from first axis 62. A tab 83 extends away from an upper portion 80-1 of front latch member 80. In the present embodiment, first sidewall 82 is formed as an elongate plate having a first interconnecting feature 84.

Second latch device 56 includes a rear latch member 86 and a second sidewall 88. In some embodiments, second sidewall 88 may be accompanied by an opposing sidewall 88-1 (see, e.g., FIG. 5) that is spaced apart from second sidewall 88 in a direction parallel to bi-directional main scan direction 48. Rear latch member 86 extends upwardly from second axis 68. Second sidewall 88 is formed as an elongate plate having a second interconnecting feature 90 positioned to engage first interconnecting feature 84 of first sidewall 82 in a central region 92 between first axis 62 and second axis 68 so as to interconnect first latch device 54 to second latch device 56. Thus, by virtue of the engagement of first interconnecting feature 84 with second interconnecting feature 90, a rotation of first latch device 54 in a first rotational direction 94 around first axis 62 results in a corresponding and opposite rotation of second latch device 56 in a second rotational direction 96 around second axis 68 opposite to first rotational direction 94.

A first spring 98 is located to apply a force in direction 100 to first latch device 54 to push first latch device 54 toward first latched position 64, and in turn to move second latch device 56 toward second latched position 72 as a result of the engagement of second interconnecting feature 90 of second sidewall 88 with first interconnecting feature 84 of first sidewall 82. A second spring 102 is positioned to apply an upward force in direction 104 (see, e.g., FIG. 6) to ink supply cartridge 32 near the rear of ink supply cartridge 32 when ink supply cartridge 32 is inserted into printhead carrier 30. A third 103 is positioned to apply an upward force in direction 104 (see, e.g., FIG. 6) to ink supply cartridge 32 near the front of ink supply cartridge 32 when ink supply cartridge 32 is inserted into printhead carrier 30.

During a loading of ink supply cartridge 32 in printhead carrier 30, ink supply cartridge 32 is inserted vertically in direction 50 between said front latch member 80 and rear latch member 86, thereby pushing against front latch member 80 and rear latch member 86 to overcome the force applied by first spring 98 so as to rotate first latch device 54 toward first unlatched position 66 and to rotate second latch device 56 toward second unlatched position 74. At a conclusion of the loading (see FIG. 4), first spring 98 forces front latch member 80 to engage a front latch feature 106 on a front portion 32-1 of ink supply cartridge 32, and by virtue of the engagement of second interconnecting feature 90 of second sidewall 88 with first interconnecting feature 84 of first sidewall 82 (see also FIG. 3), rear latch member 86 is moved to engage a rear latch feature 108 on a rear portion 32-2 of ink supply cartridge 32 to latch ink supply cartridge 32 in printhead carrier 30. Front latch member 80 and rear latch member 86 may be even with, or lower than, the top 32-3 of ink supply cartridge 32 if front latch feature 106 and rear latch feature 108 are located on ink supply cartridge 32 lower than top 32-3.

Figure 3:
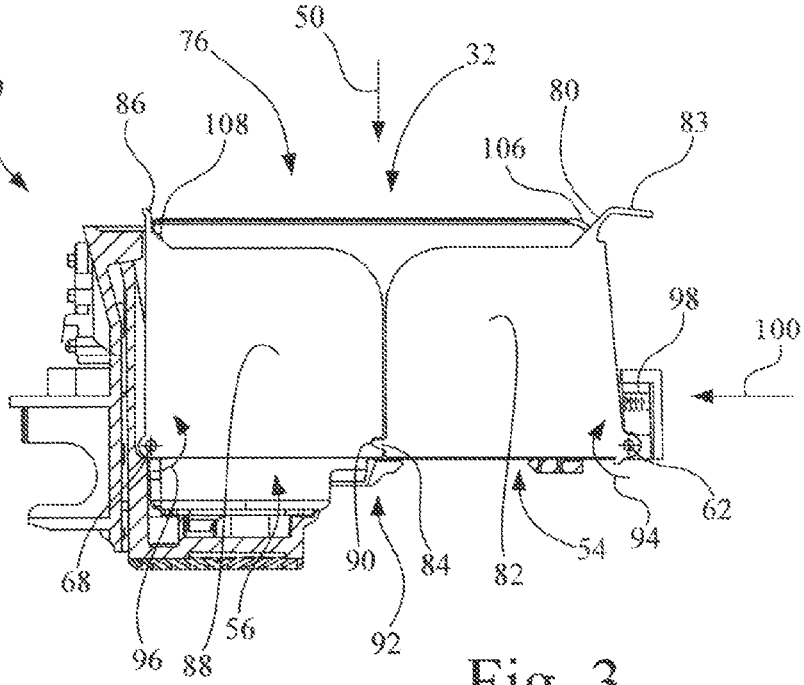
FIG. 3 is a side section view of the printhead carrier of FIG. 2 taken along line 3-3.
Figure 4:
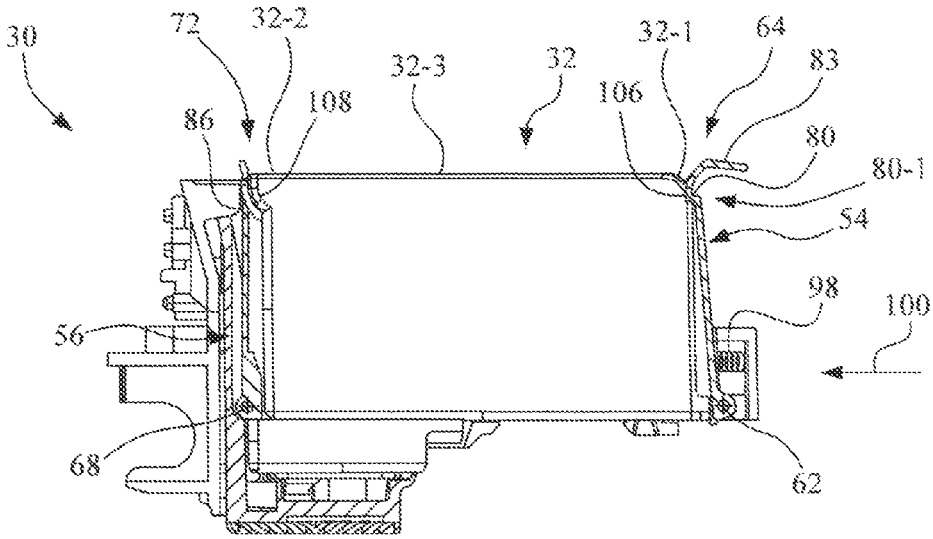
FIG. 4 is a side section view of the printhead carrier of FIG. 2 taken along line 4-4, with the ink supply cartridge shown in the latched position.

Referring to FIGS. 3 and 4, when said ink supply cartridge 32 is latched in printhead carrier 30, front latch member 80 is engaged with front latch feature 106 on front portion 32-1 of ink supply cartridge 32 and rear latch member 86 is engaged with rear latch feature 108 on rear portion 32-2 of ink supply cartridge 32. For example, front latch member 80 may extend over front latch feature 106 of ink supply cartridge 32, and rear latch member 86 may extend over rear latch feature 108 of ink supply cartridge 32. In addition, front latch feature 106 and rear latch feature 108 may serve as positioning datums for ink supply cartridge 32.

Figure 5:
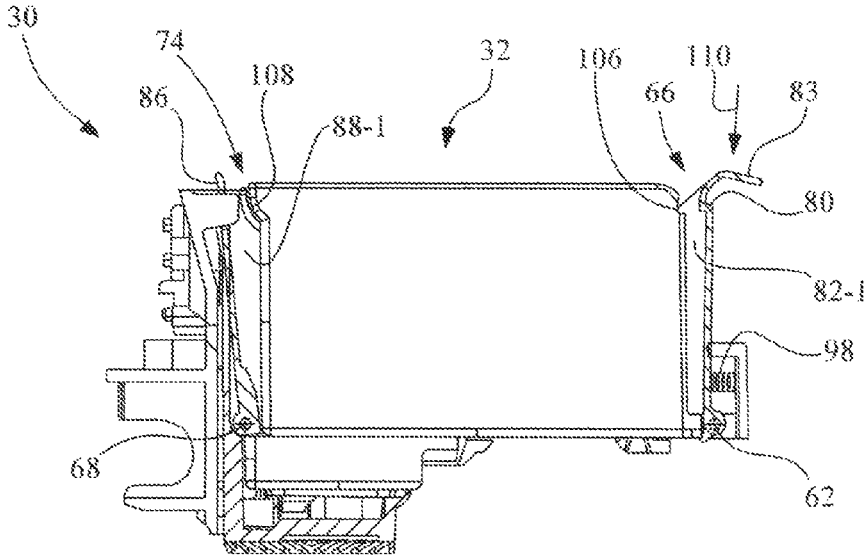
FIG. 5 is a side section view of the printhead carrier similar to FIG. 4, immediately after the ink supply cartridge is unlatched.
Figure 6:
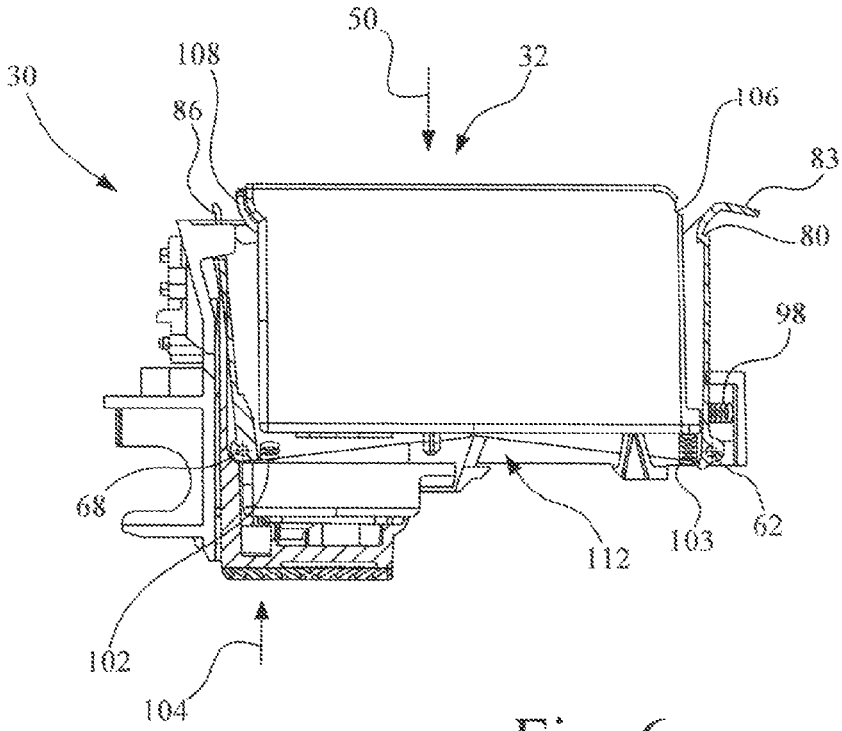
FIG. 6 is a side section view of the printhead carrier similar to FIG. 4, after the ink supply cartridge is unlatched and raised by a spring to a cartridge removal position.

Referring to FIGS. 5 and 6, upon application of a downward force 110 to tab 83 of front latch member 80 by a user, first latch device 54 is rotated to first unlatched position 66 and simultaneously second latch device 56 is rotated to second unlatched position 74 to release ink supply cartridge 32. For example, when tab 83 of front latch member 80 is pressed, the rotation of first latch device 54 causes first interconnecting feature 84 (see FIG. 3) to rotate and lift second latch device 56 with second interconnecting feature 90. In turn, second spring 102 and third spring 103 each apply an upward force in direction 104 to ink supply cartridge 32 so as to lift ink supply cartridge 32 when ink supply cartridge 32 is released by front latch member 80 and rear latch member 86, so as to position ink supply cartridge 32 in a cartridge removal position 112.

It is contemplated that springs 98 and 103 may be combined into a single spring so as to combine the functionality of springs 98 and 103 in a compact unit. Also, while springs 98, 102, and 103 are shown as compression springs, those skilled in the art will recognize that other types of springs may be used, such as for example, a leaf spring, a torsion spring, etc.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus configured for mounting an ink supply cartridge, comprising:

a guide frame defining a main scan direction; and a printhead carrier for mounting said ink supply cartridge, said printhead carrier being coupled to said guide frame for reciprocating movement along said main scan direction, said printhead carrier including:

a housing cradle having a front portion and a rear portion;

a first latch device pivotally coupled at a first axis to said front portion of said housing cradle, said first latch device being rotatable between a first latched position and a first unlatched position;

a second latch device pivotally coupled at a second axis to said rear portion of said housing cradle, said second latch device being rotatable between a second latched position and a second unlatched position;

said first latch device and said second latch device being configured with said first axis and said second axis in a substantially horizontal plane at a bottom of the cradle to define a top opening for vertically receiving said ink supply cartridge between said first latch device and said second latch device, the first and second latch device to counter pivot at the bottom of the cradle to eject the ink supply cartridge upward.

2. The imaging apparatus of claim 1, wherein, said first latch device includes:

a front latch member extending upwardly from said first axis; and a first sidewall having a first interconnecting feature, and said second latch device includes:

a rear latch member extending upwardly from said second axis; and a second sidewall having a second interconnecting feature positioned to engage said first interconnecting feature of said first sidewall in a central region between said first axis and said second axis so as to interconnect said first latch device to said second latch device.

3. The imaging apparatus of claim 2, further comprising a first spring located to apply a force to said first latch device to push said first latch device toward said first latched position, and in turn to move said second latch device toward said second latched position as a result of the engagement of said second interconnecting feature of said second sidewall with said first interconnecting feature of said first sidewall.

4. The imaging apparatus of claim 3, wherein during a loading of said ink supply cartridge in said printhead carrier, said ink supply cartridge is inserted vertically between said front latch member and said rear latch member, thereby pushing against said front latch member and said rear latch member to overcome said force applied by said first spring so as to rotate said first latch device toward said first unlatched position and to rotate said second latch device toward said second unlatched position.

5. The imaging apparatus of claim 4, wherein at a conclusion of said loading, said first spring forces said front latch member to engage a front latch feature on a front portion of said ink supply cartridge, and by virtue of said engagement of said second interconnecting feature of said second sidewall with said first interconnecting feature of said first sidewall, said rear latch member is moved to engage a rear latch feature on a rear portion of said ink supply cartridge to latch said ink supply cartridge in said printhead carrier.

6. The printhead carrier of claim 2, further comprising a first spring located to apply a force to said first latch device to push said first latch device toward said first latched position, and in turn to move said second latch device toward said second latched position as a result of the engagement of said second interconnecting feature of said second sidewall with said first interconnecting feature of said first sidewall.

7. The printhead carrier of claim 6, wherein during a loading of said ink supply cartridge in said printhead carrier, said ink supply cartridge is inserted vertically between said front latch member and said rear latch member, thereby pushing against said front latch member and said rear latch member to overcome said force applied by said first spring so as to rotate said first latch device toward said first unlatched position and to rotate said second latch device toward said second unlatched position.

8. The printhead carrier of claim 7, wherein at a conclusion of said loading, said first spring forces said front latch member to engage a front latch feature on a front portion of said ink supply cartridge, and by virtue of said engagement of said second interconnecting feature of said second sidewall with said first interconnecting feature of said first sidewall, said rear latch member is moved to engage a rear latch feature on a rear portion of said ink supply cartridge to latch said ink supply cartridge in said printhead carrier.

9. The imaging apparatus of claim 1, wherein said first latch device includes a first sidewall having a first interconnecting feature, and said second latch device includes a second sidewall having a second interconnecting feature positioned to engage said first interconnecting feature of said first sidewall in a central region between said first axis and said second axis, wherein by virtue of the engagement of said first interconnecting feature with said second interconnecting feature, a rotation of said first latch device in a first rotational direction results in a corresponding rotation of said second latch device in a second rotational direction opposite to said first rotational direction.

10. The imaging apparatus of claim 9, wherein said first latch device includes a front latch member extending upwardly from said first axis and said second latch device includes a rear latch member extending upwardly from said second axis, wherein when said ink supply cartridge is latched in said printhead carrier, said front latch member is engaged with a front latch feature on a front portion of said ink supply cartridge and said rear latch member is engaged with a rear latch feature on a rear portion of said ink supply cartridge.

11. The imaging apparatus of claim 10, wherein said first latch device includes a tab extending away from an upper portion of said front latch member, wherein upon application of a force to said tab by a user, said first latch device is rotated to said first unlatched position and simultaneously said second latch device is rotated to said second unlatched position to release said ink supply cartridge.

12. The imaging apparatus of claim 11, further comprising a second spring positioned to apply an upward force to said ink supply cartridge so as to lift said ink supply cartridge when said ink supply cartridge is released.

13. A printhead carrier for mounting and latching an ink supply cartridge, comprising:

a housing cradle having a front portion and a rear portion;

a first latch device pivotally coupled at a first axis to said front portion of said housing cradle, said first latch device being rotatable between a first latched position and a first unlatched position;

a second latch device pivotally coupled at a second axis to said rear portion of said housing cradle, said second latch device being rotatable between a second latched position and a second unlatched position;

said first latch device and said second latch device being configured with said first axis and said second axis in a substantially horizontal plane at a bottom of the cradle to define a top opening for vertically receiving said ink supply cartridge between said first latch device and said second latch device, the first and second latch device to counter pivot at the bottom of the cradle to eject the ink supply cartridge upward.

14. The printhead carrier of claim 13, wherein, said first latch device includes:

a front latch member extending upwardly from said first axis; and a first sidewall having a first interconnecting feature, and said second latch device includes:

a rear latch member extending upwardly from said second axis; and a second sidewall having a second interconnecting feature positioned to engage said first interconnecting feature of said first sidewall in a central region between said first axis and said second axis so as to interconnect said first latch device to said second latch device.

15. The printhead carrier of claim 13, wherein said first latch device includes a first sidewall having a first interconnecting feature, and said second latch device includes a second sidewall having a second interconnecting feature positioned to engage said first interconnecting feature of said first sidewall in a central region between said first axis and said second axis, wherein by virtue of the engagement of said first interconnecting feature with said second interconnecting feature, a rotation of said first latch device in a first rotational direction results in a corresponding rotation of said second latch device in a second rotational direction opposite to said first rotational direction.

16. The printhead carrier of claim 15, wherein said first latch device includes a front latch member extending upwardly from said first axis and said second latch device includes a rear latch member extending upwardly from said second axis, wherein when said ink supply cartridge is latched in said printhead carrier, said front latch member is engaged with a front latch feature on a front portion of said ink supply cartridge and said rear latch member is engaged with a rear latch feature on a rear portion of said ink supply cartridge.

17. The printhead carrier of claim 16, wherein said first latch device includes a tab extending away from an upper portion of said front latch member, wherein upon application of a force to said tab by a user, said first latch device is rotated to said first unlatched position and simultaneously said second latch device is rotated to said second unlatched position to release said ink supply cartridge, and further comprising a spring positioned to apply an upward force to said ink supply cartridge so as to lift said ink supply cartridge when said ink supply cartridge is released.

18. A printhead carrier for mounting and latching an ink supply cartridge, comprising:

a housing cradle having a front portion and a rear portion;

a first latch device pivotally coupled at a first axis to said front portion of said housing cradle, said first latch device being rotatable between a first latched position and a first unlatched position, said first latch device having a first sidewall having a first interconnecting feature; and a second latch device pivotally coupled at a second axis to said rear portion of said housing cradle, said second latch device being rotatable between a second latched position and a second unlatched position, said second latch device having a second sidewall having a second interconnecting feature positioned to engage said first interconnecting feature of said first sidewall in a central region between said first axis and said second axis, wherein by virtue of the engagement of said first interconnecting feature with said second interconnecting feature, a rotation of said first latch device in a first rotational direction results in a corresponding rotation of said second latch device in a second rotational direction opposite to said first rotational direction, said first and second latches being configured with said first axis and said second axis in a substantially horizontal plane at a bottom of the housing cradle.

* * * * *